United States Patent [19]

Sireix

[11] Patent Number: 4,474,564

[45] Date of Patent: Oct. 2, 1984

[54] MACHINE FOR FORMING TUBULAR PROFILE

[76] Inventor: George Sireix, 9, Rue Saint-Marc, 68400 Riedisheim (Haut-Rhin), France

[21] Appl. No.: 253,823

[22] Filed: Apr. 13, 1981

[30] Foreign Application Priority Data

Apr. 15, 1980 [FR] France ..... 80 08667

[51] Int. Cl.[3] ..... B31B 1/10; B31B 1/16; B31B 1/26

[52] U.S. Cl. ..... 493/279; 493/289; 493/295; 493/297; 493/302

[58] Field of Search ..... 493/289, 297, 294, 302, 493/295, 224, 223, 346, 381, 97, 278, 282, 283, 276, 279, 280

[56] References Cited

U.S. PATENT DOCUMENTS

| | | | |
|---|---|---|---|
| 2,256,263 | 9/1941 | Haycock | 493/289 X |
| 2,714,997 | 8/1955 | Weisbart | 493/302 X |
| 2,933,988 | 4/1960 | Stark | 493/302 |
| 3,280,707 | 10/1966 | Cappella | 493/279 |
| 3,304,844 | 2/1967 | Hosenfeld | 493/302 X |
| 4,258,613 | 3/1981 | Fegley et al. | 493/289 X |
| 4,353,764 | 10/1982 | Sireix | 493/302 X |

*Primary Examiner*—James F. Coan

*Attorney, Agent, or Firm*—Robert E. Burns; Emmanuel J. Lobato; Bruce L. Adams

[57] ABSTRACT

In a machine for forming a continuous tube which is then cut up into sections, for example to make containers, a plurality of bands of fibrous, cellulosic, metallic, plastic or other material are drawn from supply reels and pass through a gluing and labelling section where adhesive is applied to one side of the bands and labels are applied to the outer face of the center band. After application of the adhesive and labels, the bands, while continuing to move forwardly, are assembled in superposed relation with the bands laterally displaced relative to one another so that the edges of the assembly of bands are stepped. The bands are pressed together in a narrow central width only so as to bond central portions together while leaving side portions unbonded. The band assembly is then progressively formed into tubular profile, thereby bringing opposite side edges together, and subjected to pressure to bond the bands together throughout their width, bond side edges together and impart the finished shape, which may be circular or polygonal. The tubular profile thus formed is cut into sections while it continues to move forwardly and the sections are discharged from the machine.

32 Claims, 21 Drawing Figures

329
273
290
274
279
281
283
287
272
285
294
297
296
293
275
276
328
270
268
269
289
278
280
282
286
339
284
338
335
330
333
267
303
301
302
304
299
300
332
331
337
271
291
292
298
334
336
295
121
277
288
283
287

MACHINE FOR FORMING TUBULAR PROFILE

FIELD OF INVENTION

The present invention relates to machine for continuously forming a tubular profile made up of a plurality of bands glued together, such bands made of fibrous cellulosic, metalic, plastic, or other material.

BACKGROUND OF INVENTION

U.S. Pat. No. 3,942,418 discloses a machine permitting the continuous formation of a tubular profile made up of a plurality of bands. This machine comprises a frame having a table traversed by a pivot. A horizontal support can pivot on this pivot to form a certain angle with the longitudinal axis of the machine. On this support there are two rotatable drums connected with one another by a belt. The belt is wound partially around a spindle, one end of which is engaged in the head stock. The two drums are disposed on opposite sides of the spindle. The angular position of these drums, as well as their speed of rotation, is a function of the diameter of the tubular element as well as the thickness of its wall. By reason of the drums being disposed at a certain angular position, the belt describes a helical movement producing on the one hand helical winding of the different bands of paper, metal or other material previously provided with a layer of glue, and, on the other hand, the continuous advance of the tubular element on the spindle. This machine is provided with a multiple cutting device which is displaceable in the direction of the axis of advance of the tubular element, the speed of advance of the cutting device being synchronized with the speed of advance of the tubular element through driving and control means coordinated with the means for forming the tubular element.

From French Pat. No. 2,370,581, there is known a practically identical machine provided with a cut-off device with tubular elements of pasteboard and analagous materials comprising control means actuated by reference marks provided on the tubular element by labels or by the leading edge of the tubular element actuating a translation device of a carriage provided with at least one cutting element of which the speed of advance is regulated by a synchronization assembly. The control means comprise a guide barrel provided with detecting means such as a photoelectric cell which is displaceable along a slot in the barrel by manual control and/or by control through the intermediary of a micromoter.

However, these machines permit the production only of tubular profiles having a round cross-section.

There are also known machines permitting the fabrication of tubular profiles having a square or rectangular cross-section. These profiles are constituted of a plurality of layers of bands of fibrous cellulosic, metallic, or plastic materials. The width of each band is increased as a function of the thickness of the material used. For this purpose, there is known from U.S. Pat. No. 2,256,263 a process and apparatus for the formation of a hollow body of paper.

The process described in this patent consists of continuously feeding a plurality of superposed bands of paper of which the edges are displaced laterally and progressively. Liquid adhesive is applied to the surfaces of the bands to make them adhere to one another. The assembled bands are compressed to form a continuous multiply band having edges which are feathered or tapered in opposite directions while continuing the continuous displacement of the multiply band. The multiply band is progressively fashioned into the form of a tube while the adhesive between the plies is still wet. The edges tapered in opposite directions are abutted to form a continuous tube having a thickness uniform throughout its length. Heat is applied to the tube while it is being displaced longitudinally and maintained in its tubular form to dry the adhesive and to maintain the tubular form. The continuous tube is then cut into lengths of tubular bodies.

Apparatus for carrying out this process comprises a rack in which a plurality of rolls of paper bands are supported. Paper bands traverse a glue machine where adhesive is supplied. This glue machine comprises vats, non-adjustable in height, and the gluing is effected by the single passage of the band over a glue roller without the possibility of applying a coating of glue to opposite sides of each band. For that reason, it is necessary to provide a vat for each band.

The different bands are led toward a press composed of an upper roller and a lower roller. This press assures the assembly of the different bands throughout their widths to form a compact band having multiple plies of which the superposed plies are adhered to one another.

The compact multiply band thus obtained passes to a forming machine comprising an outer forming mandrel and an inner forming mandrel and the compact multiply band gradually modifies its form, that is to say, a flat multiply band is formed into a continuous cylindrical tube. Then, the cylindrical tube is directed into a drying oven comprising sets of upper, lower, and lateral rolls to maintain the tube cylindrical until the adhesive has dried. When the continuous tube leaves the drying oven, it passes into a cut-off machine comprising a circular saw driven by a motor mounted on a carriage displaceable longitudinally at the same speed as that at which the tube is advanced. The circular saw traversing the tube must have a radius greater than the diameter of the tube. For this reason, the diameter of the tube is limited because it is not possible to give the circular saw too great a diameter.

However, it has been observed that during formation of the tube, the outer band is subjected to separating forces while the inner band is crumpled.

SUMMARY OF THE INVENTION

To alleviate this inconvenience, there has been conceived a new process in accordance with which the assembly of bands displaced laterally, one with respect to the other and preferably coated with glue on at least one of their faces, is initially realized on a slight width, then extended to all of the perimeter of the tubular profile in the course of formation by a helical progression of this width of assembly. The helical progression is obtained by the combination of two movements, namely, on the one hand, the lateral extension of the width of the assembly and, on the other hand, the continuous advance of the ensemble of bands. Thus, the different bands can be deployed laterally, simultaneously, and in proportion to the enlargement of the zone of assembly.

While the lateral deployment is very slight, it is sufficient to avoid all pleating of the internal surface of the tubular profile and to suppress all stress of separation of the exterior band.

An object of the present invention is to provide a machine permitting the fabrication of tubular elements conforming to this new process. The invention solves the problem of creating a machine for the continuous formation of tubular profiles consisting of a plurality of bands glued together, such machine comprising essentially a press assuring the partial gluing of the different bands on a slight width while the extremities situated on both sides of the partial gluing remain independent of one another. This press is followed by means permitting enlargement of the zone of gluing while assuring the continuous advance of the ensemble of bands and of a train of pressure rolls for finishing the tubular profile, the edge-to-edge gluing of the lateral edges being effected upstream of a cutting device for making multiple peripheral cuts.

The advantages obtained by means of this invention consist essentially in that the tubular profile is stronger due to the fact that separation stresses in the exterior band are suppressed and that the internal surface is smooth and not crumpled which avoids the interior band not being glued to the adjacent band.

BRIEF DESCRIPTION OF DRAWINGS

The invention is described in more detail below with reference to the accompanying drawings illustrating by way of example a preferred embodiment. In the drawings:

With reference to FIG. 1, a machine in accordance with the invention, permitting the fabrication of tubular profiles, intended for use in packaging and consisting of a plurality of glued bands of fibrous, cellulosic, metallic, plastic, or other material comprises a plurality of assemblies disposed one behind the other in a single alignment. The first assembly is a reel section "A", provided with a station for gluing and labelling either in roll or leaf format. The different bands permitting realization of the tubular profile are mounted on the feeding reels of the reel section. These bands are coated with glue and the outer face of the outer band can be provided with labels. At the exit of the assembly "A", the different bands are directed to a forming section "B", where they are progressively formed to the rough shape of the final section of the tubular profile. Then, the assembly of the preformed bands is directed to a driving and gripping mechanism "C". From there the tubular profile is directed to a set of pressure rollers permitting the finishing of the tubular profile. The continuous tubular profile thus produced is cut into lengths by an assembly of peripheral cutters "E" and the resulting lengths are then discharged by a discharge roller "F".

With reference to FIG. 2, the reel section 1, the location of which is indicated in FIG. 1 by the letter "A", is composed of a metal framework 2 formed of two parallel longitudinal girders 3 connected with one another by transverse members 4.

Figure 1:
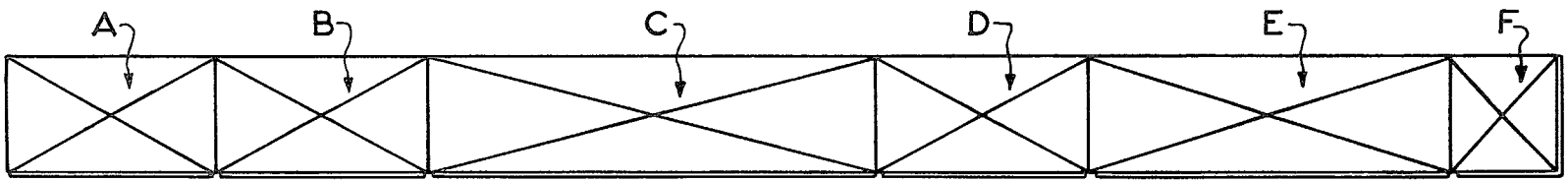
FIG. 1 is a schematic synoptic diagram of the whole machine showing the position of the different parts represented in other Figures.
Figure 2A:
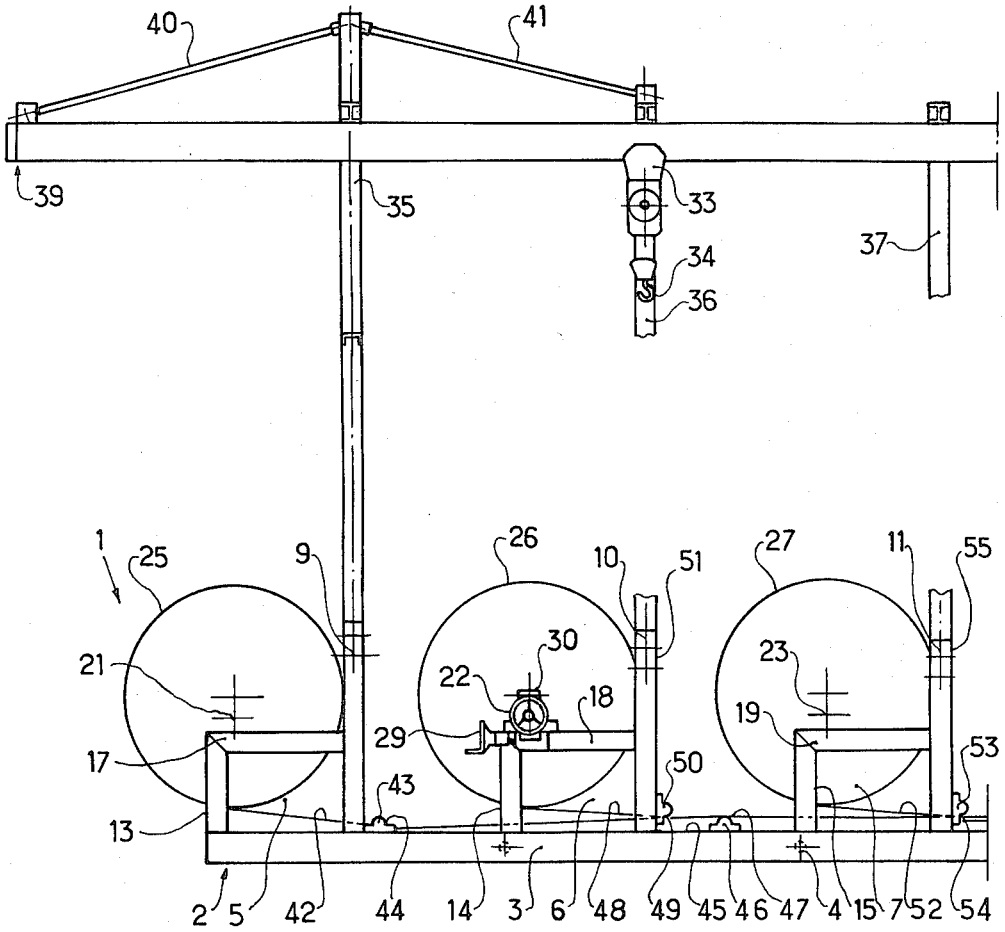
FIGS. 2A and 2B jointly illustrate a side elevation of a reel section followed by a gluing and labeling station.
Figure 2B:
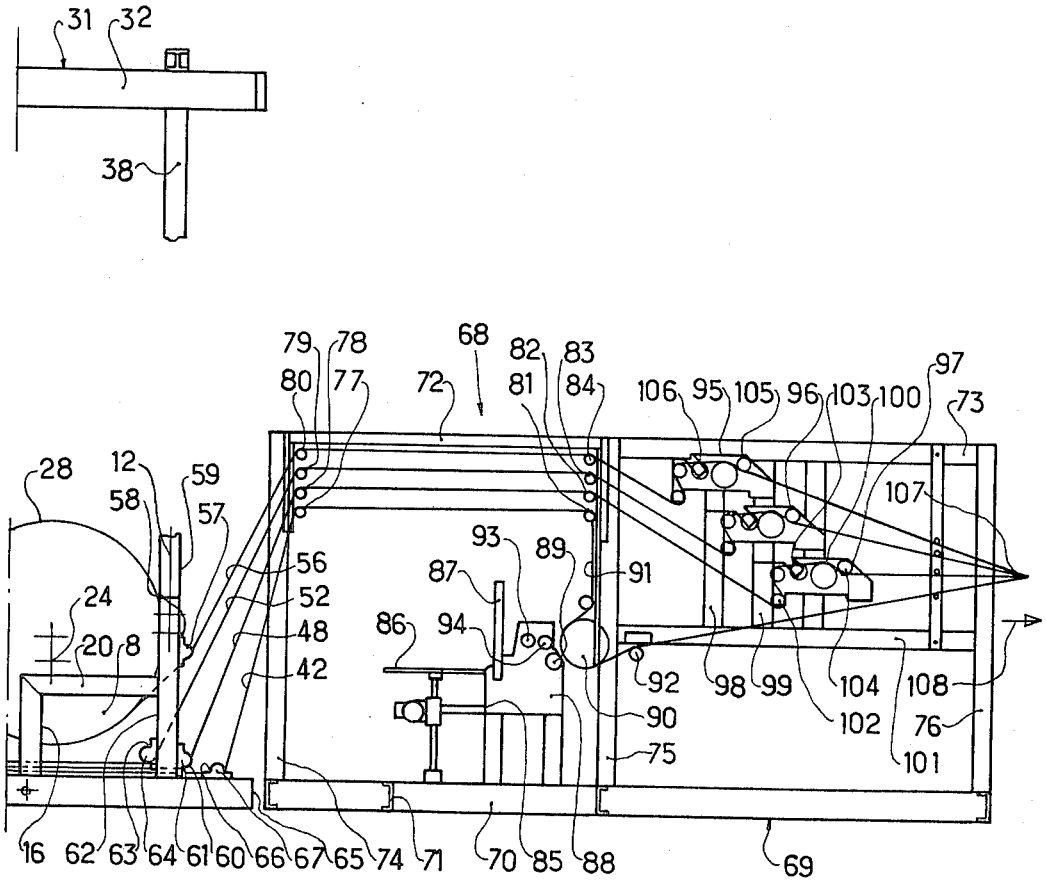

On this metal framework 2 rest successively a plurality of pairs of frames 5, 6, 7, 8, the number of which is a function of the number of superposed bands necessary to obtain the tubular profile desired. Each of the frames 5–8 is constituted by a column 9, 10, 11, 12 and a leg 13, 14, 15, 16 connected with one another by a transverse member 17, 18, 19, 20. These transverse members 17–20 serve to support pairs of spindles 21, 22, 23, 24 on which are rotatably supported the reels of band material 25, 26, 27, 28. Each of the spindles 21–24 is provided with a longitudinal adjustment assembly 29 permitting movement forward or back with respect to the columns 9–12. Moreover, each spindle 21–24 is provided with a transverse adjustment assembly 30 for positioning the reels 25–28. Indeed, each reel is displaced axially with respect to the adjacent reel. Above the reel section 1 there is a monorail 31 of which the rail 32 extends axially of the machine. A pulley block 33, provided with a hook 34 on which to suspend a reel to be manipulated runs on the rail 32. The monorail 31 is supported by posts 35, 36, 37, 38. To permit the manipulation of the reels 25–28, the forward end 39 of the rail 32 extends upstream of the first frame 5 and thus overhangs the first post 35. This end portion 39 is braced by tierods 40, 41.

The band 42 coming off the first reel 25 passes partially around a first discharge roll 43 rotatably supported by bearings 44 fixed on the upper side 45 of the longitudinal girders 3 of the metallic framework 2, then around a second roll 46 rotatably supported by bearings 47 likewise fixed on the upper side 45 of the longitudinal girders 3.

The band 48 coming off the second reel 26 first passes around a third discharge roll 49 rotatably supported by bearings 50 fixed on the rear edges 51 of the column 10, then around the second roll 46.

The band 52 coming off the third reel 27 passes around a fourth discharge roll 53 rotatably supported by bearings 54 fixed on the rear edge of the post 11.

The band 56 of the last reel 28 passes around a fifth discharge roll 57 rotatably supported by bearings 58 fixed on the rear edge 59 of the column 12 and disposed above a sixth discharge roll 60 rotatably supported by bearings 61. The band 48 coming off the second reel 26 passes partially around the discharge roll 60.

The column 12 has on its front edge 62 bearings 63 rotatably supporting a seventh discharge roll 64 acting on the band 52 coming off the third reel 27.

The longitudinal girders 3 of the metallic framework 2 have at their rear ends 65 adjustable bearings 66 rotatably supporting an eight discharge roll 67 serving as a guiding element for the band 42 coming off the first reel 25.

The bands 42, 48, 52, 56, clearly separated from one another by reason of the particular disposition of the discharge rolls 57, 60, 64, and 67, are directed to a glue-applying section 68.

This glue-applying section 68 comprises a metallic framework 69 constituted by lower longitudinal girders 70 connected with one another by transverse members 71 and upper longitudinal girders 72 connected with one another by transverse members 73. The lower longitudinal girders 70 are connected with the upper longitudinal girders 72 by vertical members 74, 75, 76.

The forward vertical members 74 serve to support a first train of guide rollers 77, 78, 79, 80 of the bands 42, 48, 52, 56. Likewise, the intermeidate vertical members 75 serve to support a second train of guide rollers 81, 82, 83, 84 which are adjustable in height in order to adjust the tension of the different bands 42, 48, 52, 56. A labeling mechanism 85 is disposed between the forward uprights 74 and the intermediate uprights 75. The labeling mechanism 85, comprising a vertically adjustable table 86 on which the labels are disposed, permits labeling continuously and/or step-by-step and/or according to a given cycle. The back of the labels manipulated by a manoeuvering arm 87 provided with a suction grip, is coated with glue in a sizing vat 88 and the labels by means of a roll 89 and a pressure counter roll 90 are applied against the outer face of the band 42 moving between the lower guide roll 81 of the second train of rolls 81–84, and an independant guide roll 92. Of course, the sizing vat 88 is provided with rotatable dip rolls 93, 94.

The other bands 48, 52, 56 are directed to sizing vats 95, 96, 97 which can be adjusted in height and are slideable along slides 98, 99, 100 fixed to intermediate longitudinal beams 101 disposed between the intermediate uprights 75 and the rear uprights 76.

Each of the sizing vats 95, 96, 97 comprises a set of three guide rolls 102, 103, 104, a glue-applying roll 105 and a dip roll 106 mixing the glue in the vat. According to a first mode of realization, both the front and the back of each band are coated with glue, while according to a second mode of realization, only the front or the back is coated. It will be understood that the term glue is used in a generic sense and that all known adhesives appropriate to the nature of the material of the bands can be used. Also the glue can be the same in each vat or different adhesives can be used.

The different bands 42, 48, 52, 56 coated with adhesive are directed to the entrance 107 of the forming mechanism 108.

Figure 3:
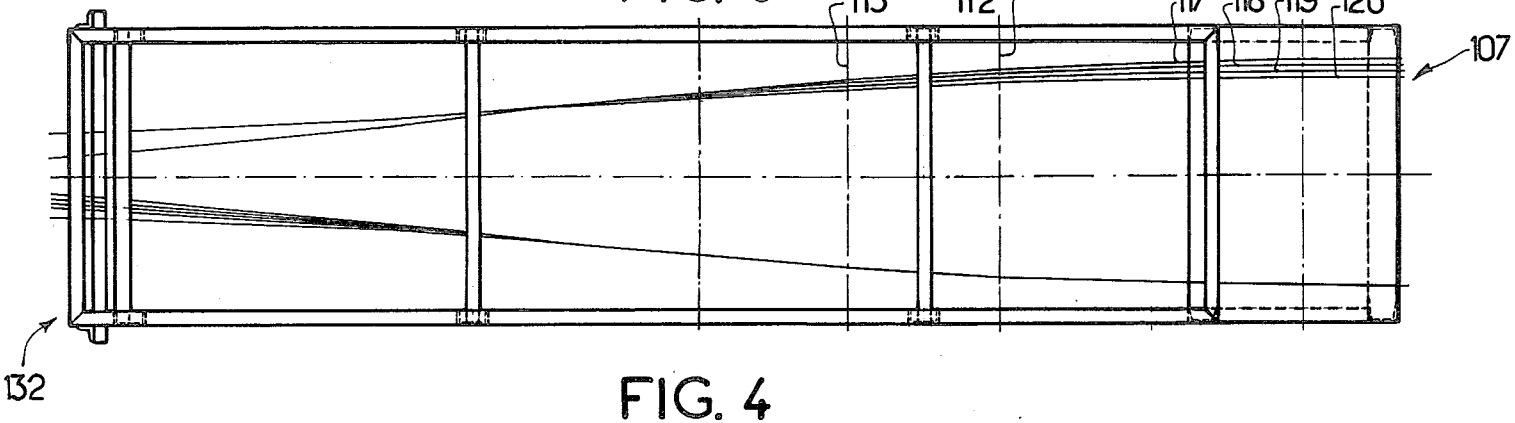
FIG. 3 is a plan view of the forming section.
Figure 4:
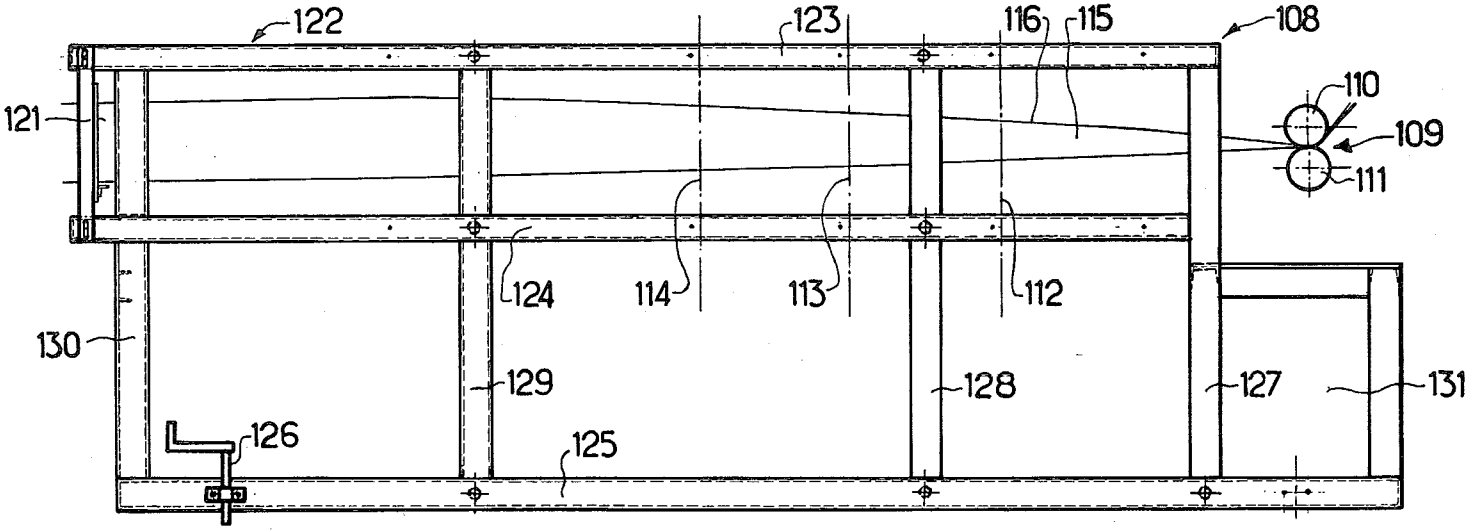
FIG. 4 is a side elevation of the same forming section.

Referring to FIGS. 3 and 4:

FIGS. 3 and 4 illustrate the forming section 108, the location of which is indicated in FIG. 1 by the letter "B". Of course, the forming applies to bands of all materials, notably metallic bonds such as aluminum, copper, and others. At the entrance 107, the forming mechanism comprises a press 109 composed of an upper roller 110 and a lower roller 111. According to the section of the tubular profile, the press 109 effects the gluing of the different bands 42, 48, 52, 56 on a slight width. According to this, in case of a tubular profile of circular section, the gluing is effected along a line situated on the axis of forming mechanism 108. To permit this gluing, the lower roll 111 has a concave surface. Owing to this, the portions of the band situated on opposite sides of this line remain independent with respect to one another.

In the case of a tubular profile of polygonal section, the upper roller 110 has a width corresponding to the width of the lower side of the polygonal tubular profile to be produced. Moreover, the lower roll 111 has a cylindrical portion abutting on both sides two fructoconical portions. The width of this cylindrical portion corresponds likewise to the width of the lower side of the polygonal section to be produced. By reason of this, the different bands 42, 58, 52, and 56 are glued on a width corresponding to the width of the lower side of the polygonal tubular profile, while the extremities of the bands 42, 48, 52, 56 situated on opposite sides of this glued width remain independent with respect to one another and can hence be spread laterally.

Downstream of this press 109 there are disposed a plurality of removable patterns 112, 113, 114 . . . each constituted essentially of a vertical panel provided with an opening permitting the progressive modification of the form of the assembly of the different bands 42, 48, 52, 56. The patterns 112, 113, 114 have a progressive form not exerting any constraint on the different bands 42, 48, 52, 56 but serving only for guiding. Because of this the extremities of the bands situated on opposite sides of the width, glued by the press 109, remain independent with respect to one another. As seen in FIG. 4, the part of the bands glued together 115, remain practially horizontal. On the contrary, the assembly of the lateral edges 116 of the bands 42, 48, 52, 56 are raised simultaneously and proportionally by their passage through the openings of the patterns 12, 13, 14. The lateral edges 117, 118, 119, 120 of the bands 42, 48, 52, 56 are displaced laterally. Thus, in the case of a tubular profile of circular section, a practically flat assembly is converted by the intermediary of the forming section into a trough form constituting the preformed tubular profile 121 obtained at the exit of the forming section 108.

The different removeable patterns 112, 113, 114 . . . are supported by a framework 122 formed of upper longitudinal members 123, intermediate longitudinal members 124 and lower longitudinal members 125 provided with means 126 for adjusting the height, these longitudinal members 123, 124, 125 being connected by legs 127, 128, 129, 130. This framework 122 likewise comprises a support 131 on which the press 109 is disposed.

At the exit 132 of the forming section 108, the preformed tubular profile 121 is next directed to driving final forming and cut-off mechanism.

Figure 5A:
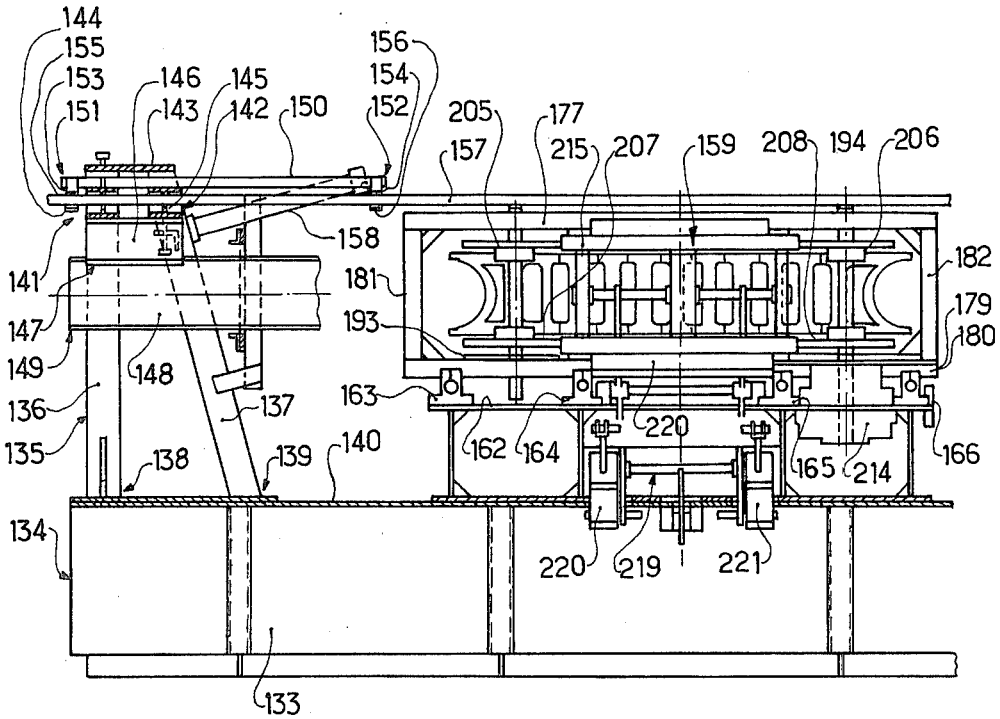
FIGS. 5A and 5B jointly illustrate side elevation of a sub-assembly of the machine disposed downstream of the forming section.
Figure 5B:
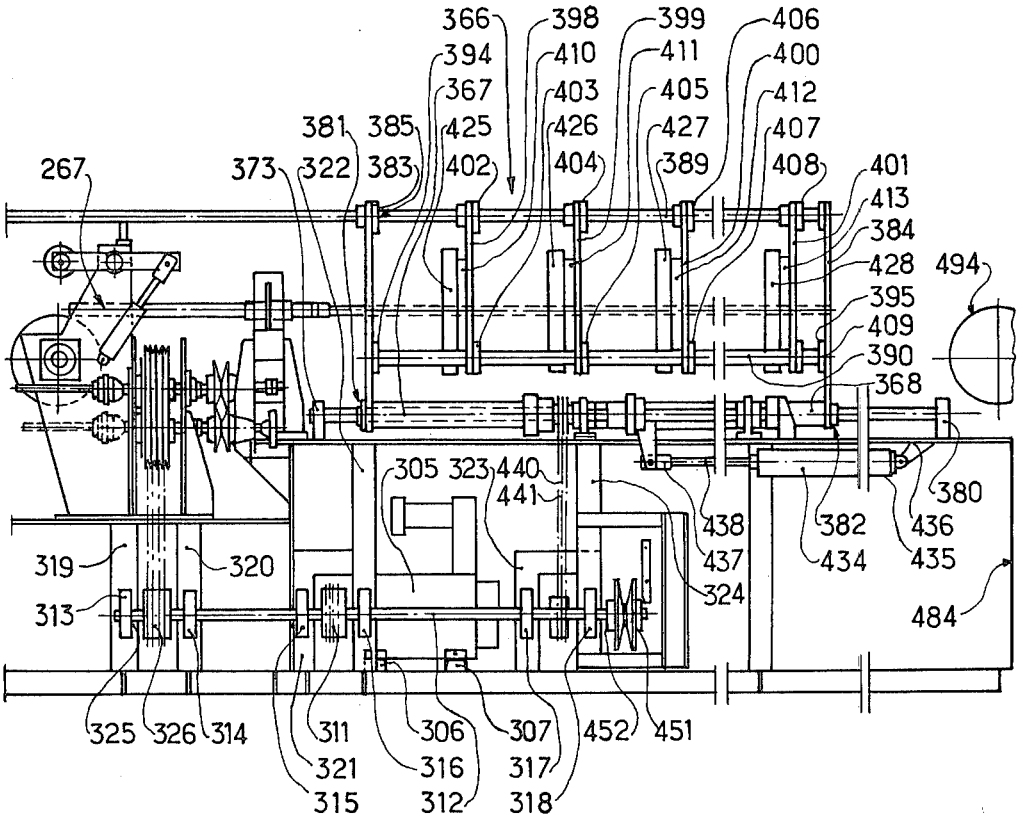
Figure 6A:
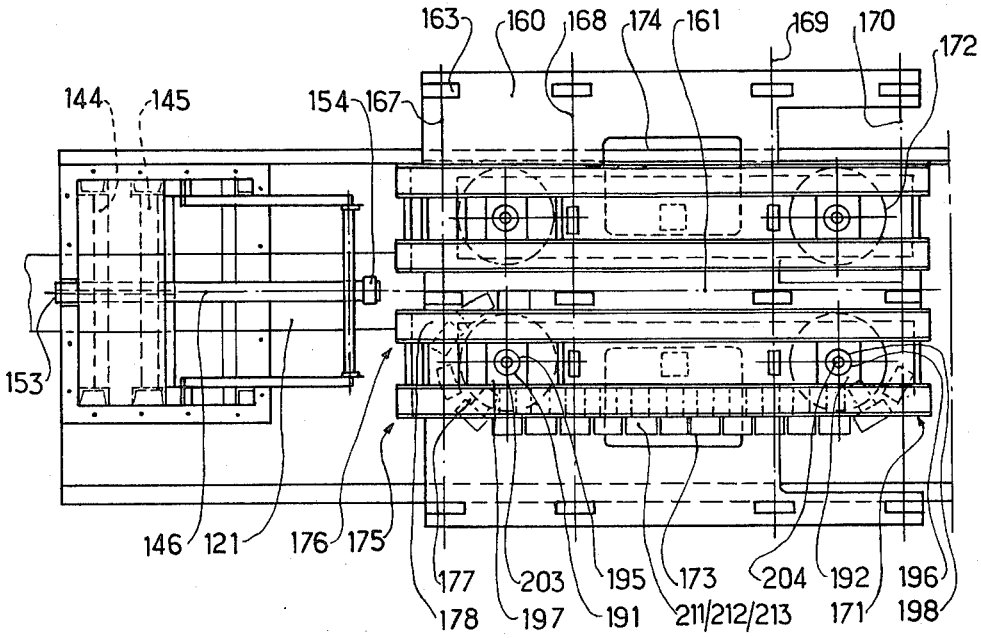
FIGS. 6A and 6B jointly illustrate a plan view of the same sub-assembly.
Figure 6B:
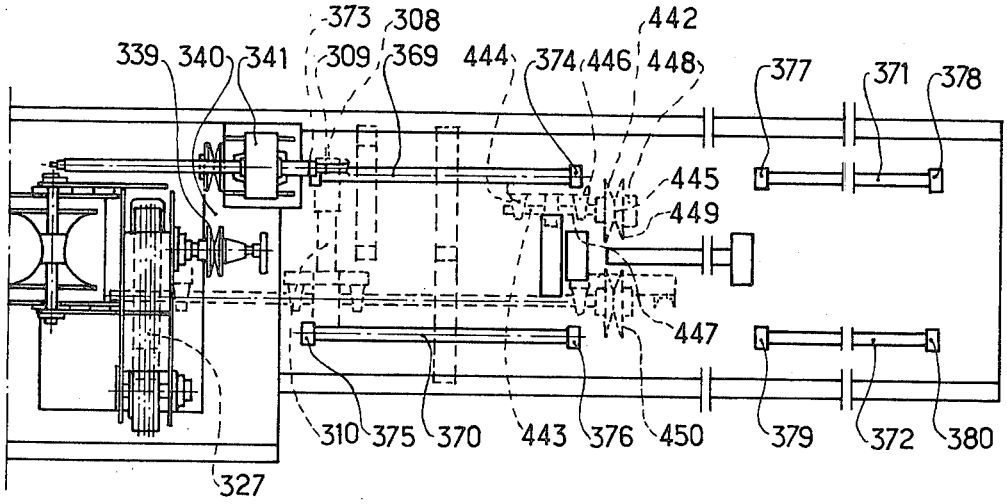

With reference to FIGS. 5 and 6:

FIGS. 5 and 6 represent the part of the machine situated downstream of the forming section 108. This part comprises a frame 133 serving as a housing for the motor elements serving for the general function of the machine. These motor elements are mechanical and/or electrical and/or pneumatic and/or electronic and necessarily comprise the corresponding different controls.

At the forward end 134 of this frame 133 there is disposed a bracket 135 formed of legs 136, 137 of which the lower ends 138, 139 rest on the top 140 of the frame 133 and of which the upper portion 141, 142 is provided with a plate 143 to which are hooked small transverse beams 144, 145 from which a longitudinal beam 146 is suspended. To the base of this longitudinal beam 146 is hooked a mandrel 148 on which is threaded the tubular profile 121 having the form of a trough coming from the forming section 108. The longitudinal beam 146 is situated on the axis of the trough 121. The mandrel 148 comprises a forward end 149 which is slightly frustoconical to facilitate on the one hand the threading of the profile onto the mandrel and, on the other hand, the finishing of forming the profile. The small transverse beams 144, 145 also serve to support a rod 150 comprising at its extremities 151, 152 bearing blocks 153, 154 provided with bearings 155, 156 in which a shaft 157 slides.

Figure 7:
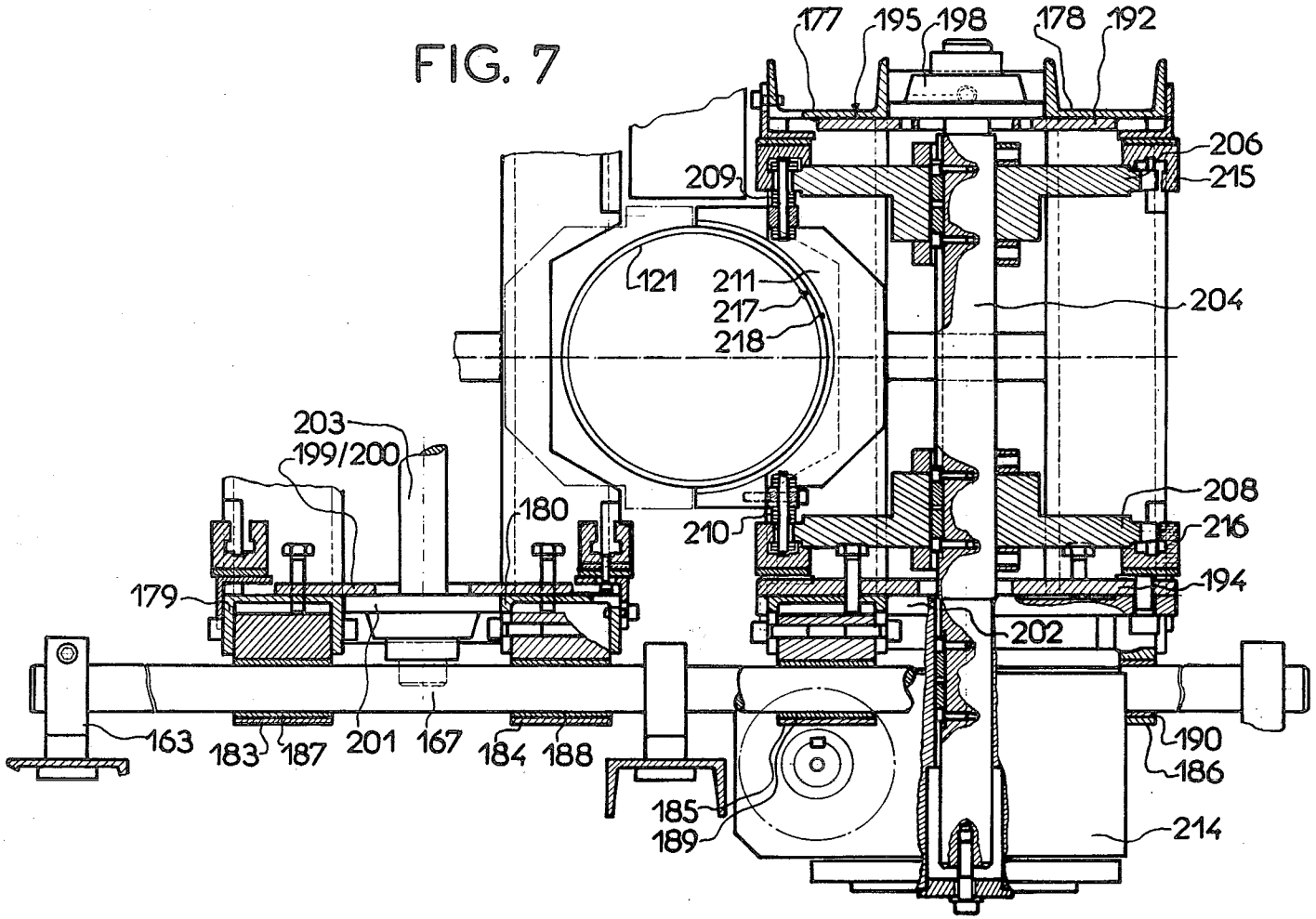
FIG. 7 is a vertical section of drive mechanism of the tubular profile.

Downstream of this bracket 135, the frame 133 supports a driving and pinching mechanism 159 permitting the gluing between the lateral extremities of the bands. This mechanism is illustrated in FIGS. 5–7.

The mechanism 159 comprises a table 160 which can have a certain inclination of which the plane of inclination is perpendicular to the longitudinal axis 161. On the top 162 of this table 160 are fixed bearings 163, 164, 165, 166 serving to support shafts 167, 168, 169, 170. On these shafts 167–170, two carriages 171, 172 are slideable toward and away from the axis 161 by means extending through openings 173, 174 provided in the table 160.

The carriages 171, 172 being practically identical, the following description will be limited to carriage 171. It will be understood that the other carriage 172 comprises the same elements.

Each carriage 171 comprises an external and internal metallic body 175, 176 formed of two parallel upper longitudinal beams 177, 178, two lower longitudinal beams 178, 179 and legs 181, 182 connecting the different beams 177–180 to one another. The lower beams 179, 180 to carry bearing blocks 183, 184, 185, 186 provided with bearings 187, 188, 189, 190 sliding on the shafts 167–170. Upper bed plates 191, 192 and lower bed plates 193, 194 are inserted between the longitudinal beams 177–180. The upper faces 195, 196 of the upper bed plates 191, 192 support bearings 197, 198. Likewise, the lower faces 199, 200 of the lower bed plates 193, 194 have bearings 201, 202. The bearings 197, 198, 201, 202 are traversed by shafts 203, 204, the forward shaft 203 being the driven shaft and the rear shaft 204 being the motor shaft. Upper sprocket wheels 205, 206 and lower sprocket wheels 207, 208 are mounted on and rotate with the shafts 203, 204. The sprocket wheels 205–208 drive two chains 209, 210 on which are fixed the clamps 211, 212, 213 . . . defining in part the exterior face of the tubular profile 121.

Through the cooperation of the clamps 211–213 of the two carriages 171,172 which are displaced in the direction of the longitudinal axis 161, there is produced a drive of the tubular profile 121. The motor shaft 203 is connected to a reducer 214. To assure constant contact between the tubular profile 121 and the clamps 211, 212, 213, the chains 209, 210 move in guide slides 215, 216.

The internal face 217 of the clamps 211, 212, 213 have a form adapted to the form of the section of the tubular profile which it is desired to obtain. This internal face comprises an elastic membrane 218 which can be subjected to the action of a fluid such as air, water, etc. By reason of this, the elastic lining 218 can be submitted to a positive or negative pressure. This makes it possible to act on the tubular profile to make a correction of thickness. Moreover, this fluid can be more or less hot which permits, on the one hand, heating of the profile and, on the other hand, a cooling after the heating. The clamps are automatic clamps assuring a mechanical application.

Figure 8:
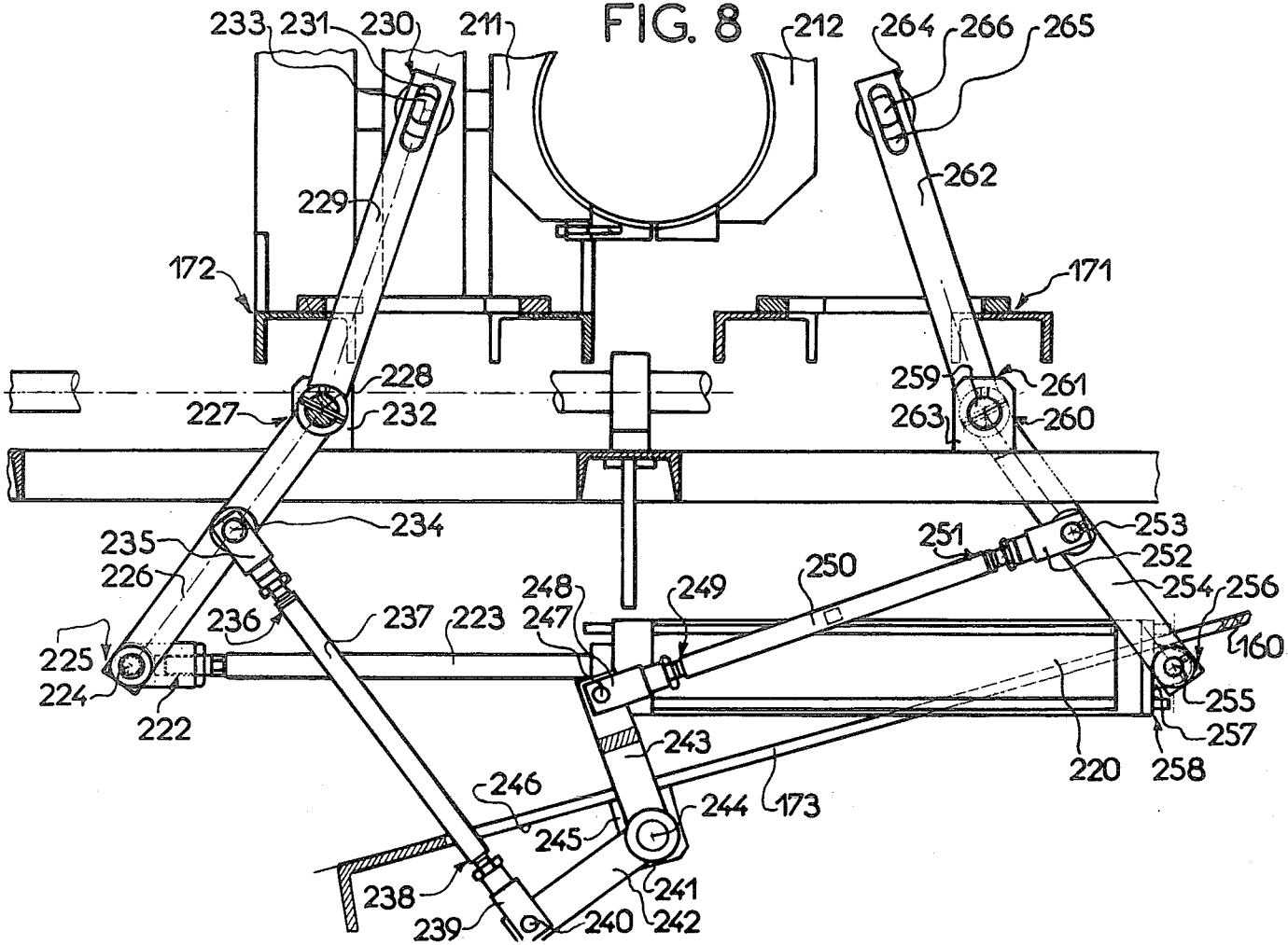
FIG. 8 is a vertical section of the closing device of the drive mechanism.

For transverse displacement of the carriages 171, 172, there is provided a closing and/or opening mechanism 219 extending through the openings 172, 174 in the table 160 of the drive mechanism 159 as illustrated in FIGS. 5, 6, and 8.

The opening and or closing mechanism 219 comprises hydraulic jacks 220, 221. However, by reason of the inclination of the table 160, it is necesary for the course of the upper carriage 171 to be lower than the course of the lower carriage 172. Indeed, the weight of the upper carriage 171 has a tendency to push the upper carriage 171 down while the lower carriage 172 should be lifted by the mechanism 219. For this reason, there is provided a regulator device to assure simultaneous contact on the one hand between the clamps 211–213 of the upper carriage 171 and the tubular profile, and, on the other hand, between the clamps 211–213 of the lower carriage 172 and the tubular profile.

The end 222 of the stem of the hydraulic jacks 220, 221 is connected by a pivot axis 224 to one of the ends 225 of a lever 226. The other end 227 of the lever 226 is connected by an axis 228 to a second lever 229 of which the other end 230 has an elongated slot 231. The axis 228 is maintained in place by a clasp 232. A shaft 233 fixed to the carriage 172 is displaceable in the elongated slot 231.

A fitting 235 adjustably fixed to one end 236 of a first rod 237 is connected with the lever 226 by an axis 234 disposed between the axes 224 and 228. The other end 238 of the rod 237 is likewise provided with a fitting 239 traversed by an axis 240 serving as a connecting element between the rod 237 and equalizing lever 241 constituted by two branches 242, 243 approximately perpendicular to one another and pivoted around an axis 244 maintained by a fitting 245 fixed to the bottom 246 of the table 160. The first branch 242 is thus connected to the rod 237 while the second branch 243 is connected by a pivot axis 247 to an adjustable fitting 248 fixed on one end 249 of a second rod 250 of which the other end 251 is provided with an adjustable fitting 252 traversed by an axis 253 serving as the connecting element between the second rod 250 and a lever 254. This axis 253 is disposed between a first pivot axis 255 connecting one end 256 of the lever 254 to a fitting 257 fixed to the end 258 of the hydraulic jacks 220, 221 and a second pivot axis 259 connecting the other end 260 of the lever 254 to one end 261 of a second lever 262. This axis 259 is held by a fitting 263. The other end 264 of the second lever 262 has an oblong slot 265 in which is displaceable an axis 266 serving as a connection between the second lever 262 and the carriage 171.

Downstream of the driving mechanism 159, the frame 133 serves as a support for a train of diabolos, or rollers, 267 for finishing the forming of the tubular profile. After passage of the profile through this train of rollers 267, the finished profile is realized. Moreover, this train of rollers permits realizing the different glue joints between the abutting lateral edges of the different bands.

Figures 9, 10:
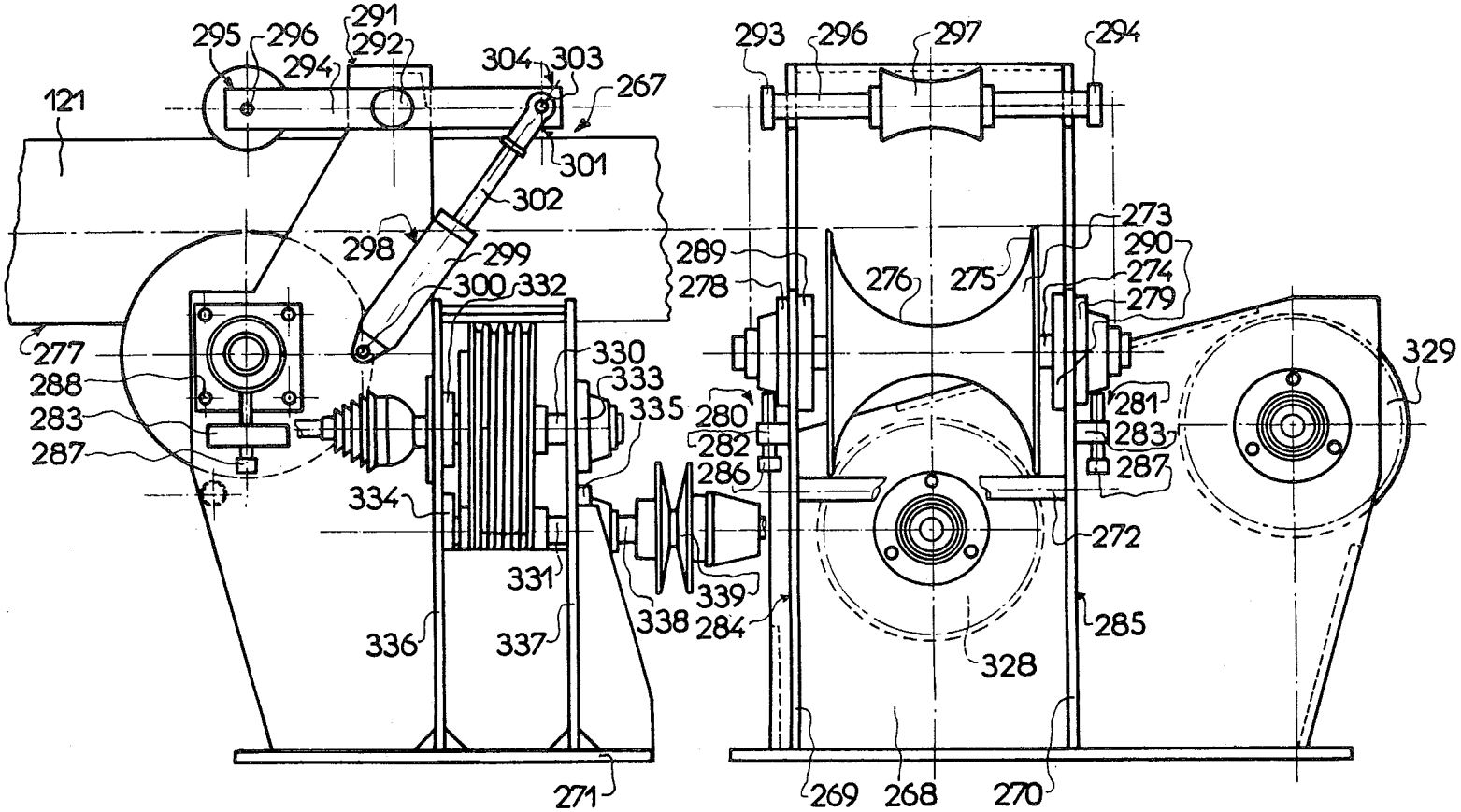
FIG. 9 is a side elevation of a train of pressure rollers permitting the finishing of the tubular profile.
FIG. 10 is an elevational view looking from the left of FIG. 9.

The location of the train of rollers illustrated in FIGS. 5, 6, 9, and 10 is represented by the letter "D" in FIG. 1. The train of rollers 267 comprises a housing 268 formed of two vetical plates 269, 270 connected by a base 271 and a tie rod 272. The two vertical plates 269, 270 serve to support a lower roller 273 freely rotatable around a horizontal axis 274. The periphery 275 of the lower roller 273 has a form adapted to the outside periphery of the tubular profile 121. In the case shown in the drawings, the tubular profile 121 has a circular section and the circumference 275 of the roll 273 has the form of a semicircular groove as seen in FIG. 10. The lower part 277 of the tubular profile 121 is placed in the bottom 276 of this groove. The horizontal axis 274 is supported by bearings 278, 279 in plates 269, 270. To assure constant contact between the lower roller 273 and the tubular profile 121 the lower roller 273 is displaceable vertically by means of adjusting elements 280, 281 formed of two screws 286, 287 screwed through nuts 282, 283 fixed on the outer faces 284, 285 of the plates 269, 270 and cooperating with the bearings 278, 279. In order to lock the bearings 278, 279 and thus the lower roller 273 in predetermined position, they are provided locking elements 288 cooperating with clamps 289, 290.

The upper ends 291 of the parallel plates 269, 270 are traversed by a shaft 292 around which are pivoted two levers 293, 294. One of the ends 295 of these levers 293, 294 is provided with a shaft 296 on which an upper diabolo or pressure roller 297 is freely rotatable. The roller 297 of a form adapted to a section of the tubular profile exerts pressure on the edges of the different bands, which permits realizing the joining of abutting edges and thus obtaining the fully completed tubular profile. To assure this pressure, there are provided two hydraulic jacks 298 of which the bodies 299 are connected by a pivot axis 300 to the plates 269, 270 and of which the ends 301 of the pistons 302 are connected by an axis 303 to the other end 304 of the levers 293, 294.

The housing 268 also serves to support a part of the driving mechanism described below. The machine 1 has a motor 305 mounted on slides 306, 307. The shaft 308 of the motor 305 is provided with a driving pulley 309 driving through a belt 10, a driven pulley 311. This driven pulley 311 is mounted on an intermediate shaft 312 supported by bearings 313–318 mounted on legs 319–324. The end 325 of the intermediate shaft 312 carries a driving pulley 326 driving through a belt 327 two driven pulleys 328, 329. The pulleys 328, 329 are fixed in rotation on two transmission shafts 330, 331 supported by bearings 332–335 fixed on vertical supports 336, 337 fixed to the housing 268 and perpendicular to the plates 269, 270. The transmission shafts 330, 331 drive the reducers 214 of the carriages 171, 172. The transmission shaft 330 has at its downstream end 333 a variable driving pulley 339 cooperating through a V-belt 340 with a variable driven pulley 341.

Figure 11:
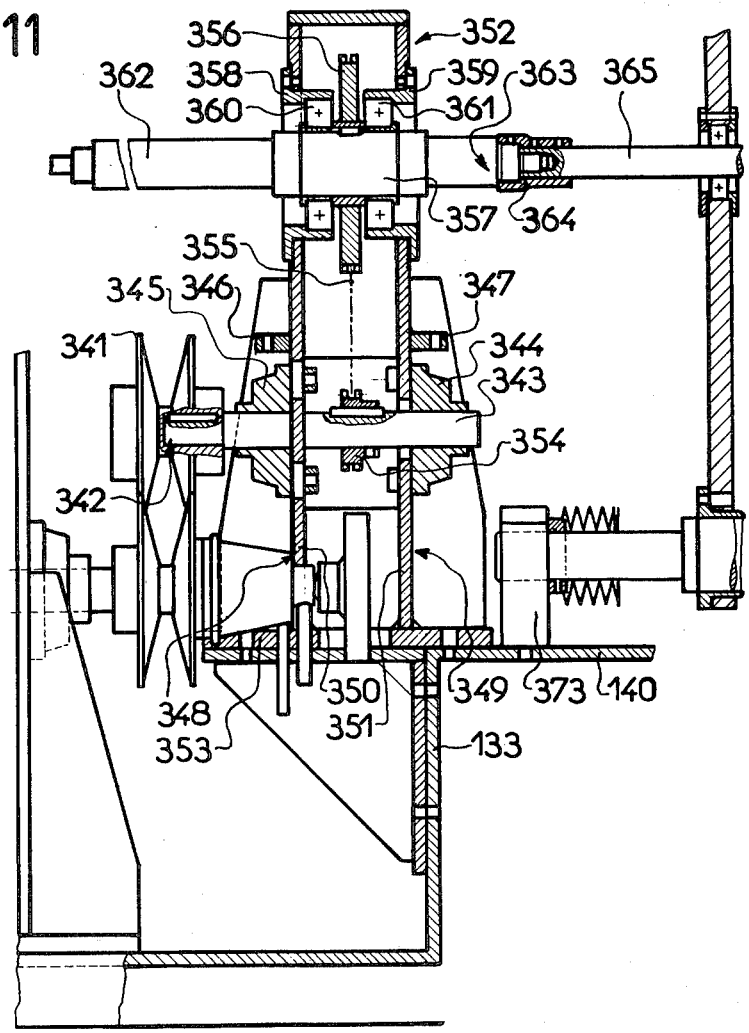
FIG. 11 is a vertical section showing a sliding turret driving in rotation the cutting turret.

Referring to FIGS. 5, 6, and 11, the variable driven pulley 341 is mounted on the end 342 of the shaft 343. It will be understood that the shaft 343 is fixed in rotation with the pulley 341. This shaft 343 is supported by bearings 344, 345 which are displaceable vertically, displacement being effected by adjusting elements 346, 347. The bearings 344, 345 slide along the external faces 348, 349 of two vertical partitions 350, 351 of a turret 352 of which the base 353 is fixed to the top 140 of the frame 133. A sprocket wheel 354 is fixed on the shaft 343 between the two vertical partitions 350, 351. The sprocket wheel 354 drives through the intermediary of a chain 355 a sprocket 356 fixed on a bushing 357 rotatably supported by bearings 358,359 comprising ball bearings 360, 361. These bearings 358, 359 are fixed on the outer faces 348, 349 of the two vertical partitions 350, 351 of the turret 352. A slide bar 362, slideable in the bushing 357, has one end 363 fixed in rotation to the end 364 of a drive shaft 365 of cutting mechanism 366 of which the position is represented by the letter "E" in FIG. 1.

The cutting mechanism 360 cuts the completed tubular profile into sections of appropriate lengths. The advance of the tubular profile being continuous, it is necessary that the cutting mechanism 366 during the cutting phase advance at the same speed as the tubular profile and, after making a cut, returns to its original position.

Referring to FIGS. 5, 6, 13, and 14.

The cutting mechanism 360 comprises four shoes 367, 368 sliding on four slide bars 369, 370, 371, 372 supported by bearings 373–380 fixed on the top of the frame 133. At their ends 381, 382, the shoes 367, 368 have two vertical end plates 383, 384. The upper end 385 of the plate 383 carries a fitting 386 fixed to the end 387 of the shaft 157. The upper end 385 of the plate 383 is connected to the upper end 388 of plate 384 by an upper shaft 389. Likewise, there are provided two lower shafts 390, 391 parallel to the shaft 390 and located below the latter. The three shafts 389, 390, 391 form an isosceles triangle. The ends 392, 393 of the lower shafts 390, 391 are supported by bearings 394, 395 fixed to the inner faces 396, 397 of the end plates 383, 384. A plurality of intermediate plates 398, 399, 400, 401, slideable on these shafts 389–391 are provided with flanges 402–409 provided with locking means. The number of these intermediate plates 398–401 is a function of the number of cuts which it is wished to effect in a given section of the tubular profile.

Bushings 414, 415 are fitted on hubs 410, 411, 412, 413 fixed on the intermediate plates 398–401. The hubs 410–413 have fluid pressure inlets 416 connected by channels 417 to a chamber 418 formed in the inner face 419 of the bushings 414, 415. On both sides of this chamber there are provided grooves 420, 421 in which are disposed sealing joints 422, 423. These grooves 420, 421 are connected with a lubrication conduit 424. On this sleeve 414, 415 there is fitted a cutting turret 425, 426. 427, 428 driven in rotation by a belt 429 which in turn is driven by a pulley 430 mounted on a hollow shaft 431 fixed in rotation with the shaft 365. This hollow shaft 431 turns in a bearing 432 provided with rollers 433 and fixed on the intermediate plates 398–401.

As for the displacement of the cutting device 366, there are provided two means which complement one another to assure perfect synchronization between displacement of the cutting device 366 and the advance of the tubular profile. The first means consists of a hydraulic jack 434 of which the body 435 is fixed by a fitting 436 on a frame 133 and of which the forward end 437 of the piston 438 is connected by a fitting 439 to the cutting device 366. The object of the hydraulic jack 434 is to provide the force necessary to advance the cutting device 366 during the cut and of returning the cutting device to its initial position after the cut. The second device is a clutch pulley 440, serving essentially to regularize the advance of the cutting device 366 to conform to the advance of the tubular profile. The clutch pulley 440 is driven through a belt 441 by a driving pulley 442 mounted fixedly on a shaft 443 rotatably supported by bearings 444, 445 fixed on supports 446, 447. This shaft 443 is provided at one of its ends 448 with a variable pulley 449 driven through a belt 450 by a variable driving pulley 451 mounted on the end 452 of the shaft 312.

This clutch pulley 440 cooperates with a ball bearing screw 453 rotatably supported by bearings 454, 455 provided with balls or rollers 456, 457 and mounted on the forward end plate 383.

Figure 14:
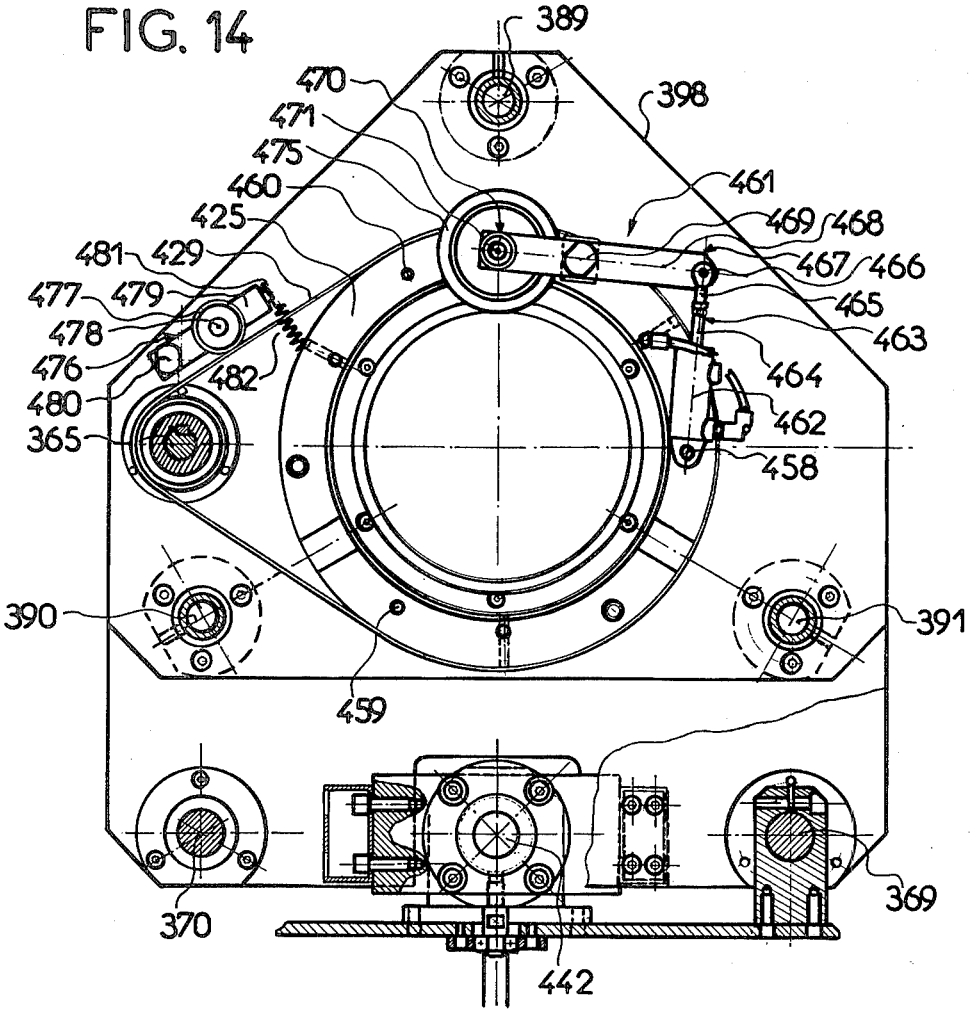
FIG. 14 is a vertical section of the cutting device.

A cutting assembly 461 is fixed on the cutting turrets 425–428 by means of an axis 458, 459, and 460. In FIG. 14 there is shown only one assembly, whereas each cutting turret 425–428 comprises a plurality of the assemblies 461 described below. Each assembly 461 comprises a hydraulic jack 462, of which the end 463 of the piston 464 is provided with a fitting 465 connected by a pviot axis 466 to the end 467 of a lever 468 which can pivot around an axis. The other end 470 of the lever 468 is provided with an adjustable pivot axis 471 provided with a ball bearing 472 serving as a connecting element between the axis 469 and two cheeks 473, 474 having a cutting blade 475 imprisoned between them.

Pressure is exerted on the belt 429 by means of a tension device 476 composed of a lever 479 pivoting around an axis 480 and a roller 477 mounted on an intermediate portion of the lever to rotate around an axis 478. A spring 482 acts on the end 481 of the lever 479 to press the roller 477 against the belt.

The operation of the cutting device 366 is as follows:

Simultaneously and proportionally to the advance of the tubular profile, the plates 398–401 are displaced horizontally under the combined action of the hydraulic jack 434 and the clutch pulley 440. Simultaneously, the cutting turrets 425–428 are driven in rotation by the shaft 365 and pivot around the advancing tubular profile. At the same time, the cutting blades 475 are applied on the periphery of the tubular profile through the intermediary of the hydraulic jacks 462. After the cut, the cutting blades 475 are disengaged and the plates 398–401 are returned to their initial position for a new cut into sections of the tubular profile carried out continuously. When the cutting device 366 advances, the end plate 384 exerts a traction on the upper axis 389. This traction is transmitted by the fitting 386 to the axis 157. Moreover, the tubular profile is maintained in the cutting device 366 by a moveable mandrel 483. A predetermined given length of the tubular profile is cut into a plurality of sections, but each section must be disengaged from the rear 484 of the machine (see FIG. 5) and it is necessary for each section to be guided by the moveable mandrel 483 up to the time of its discharge.

Figure 12A:
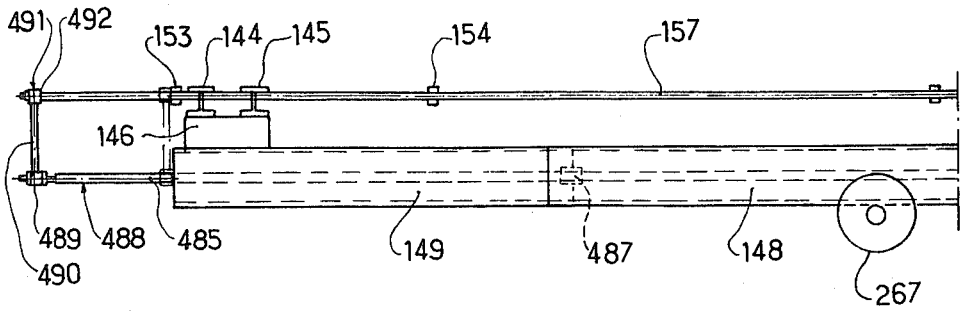
FIGS. 12A and 12B jointly illustrate a side elevation of the forming mandrel.
Figure 12B:
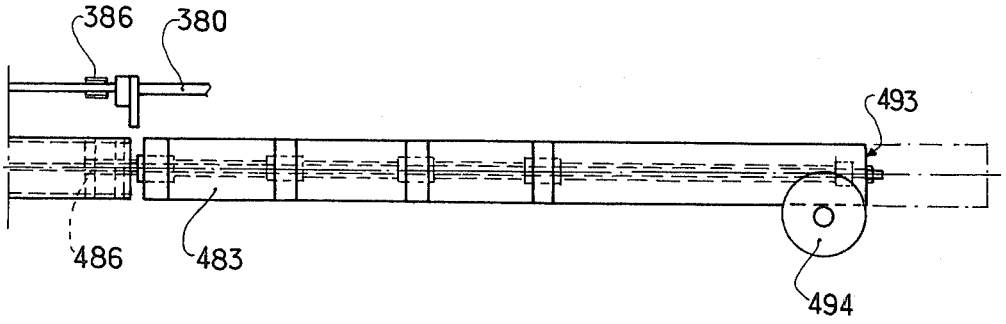
Figure 13A:
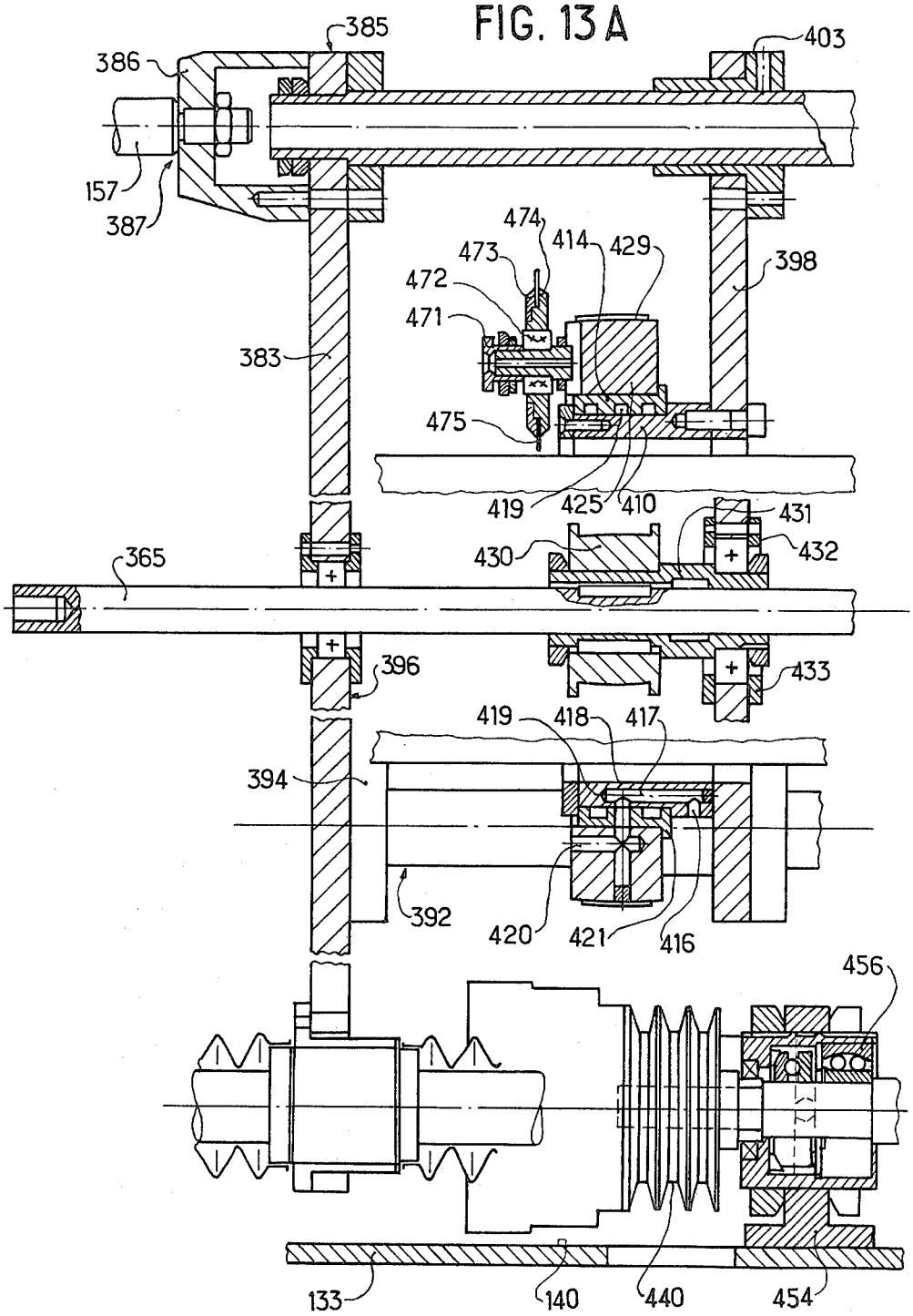
FIGS. 13A and 13B illustrate a vertical section showing the drive mechanism of the cutting turrets.
Figure 13B:
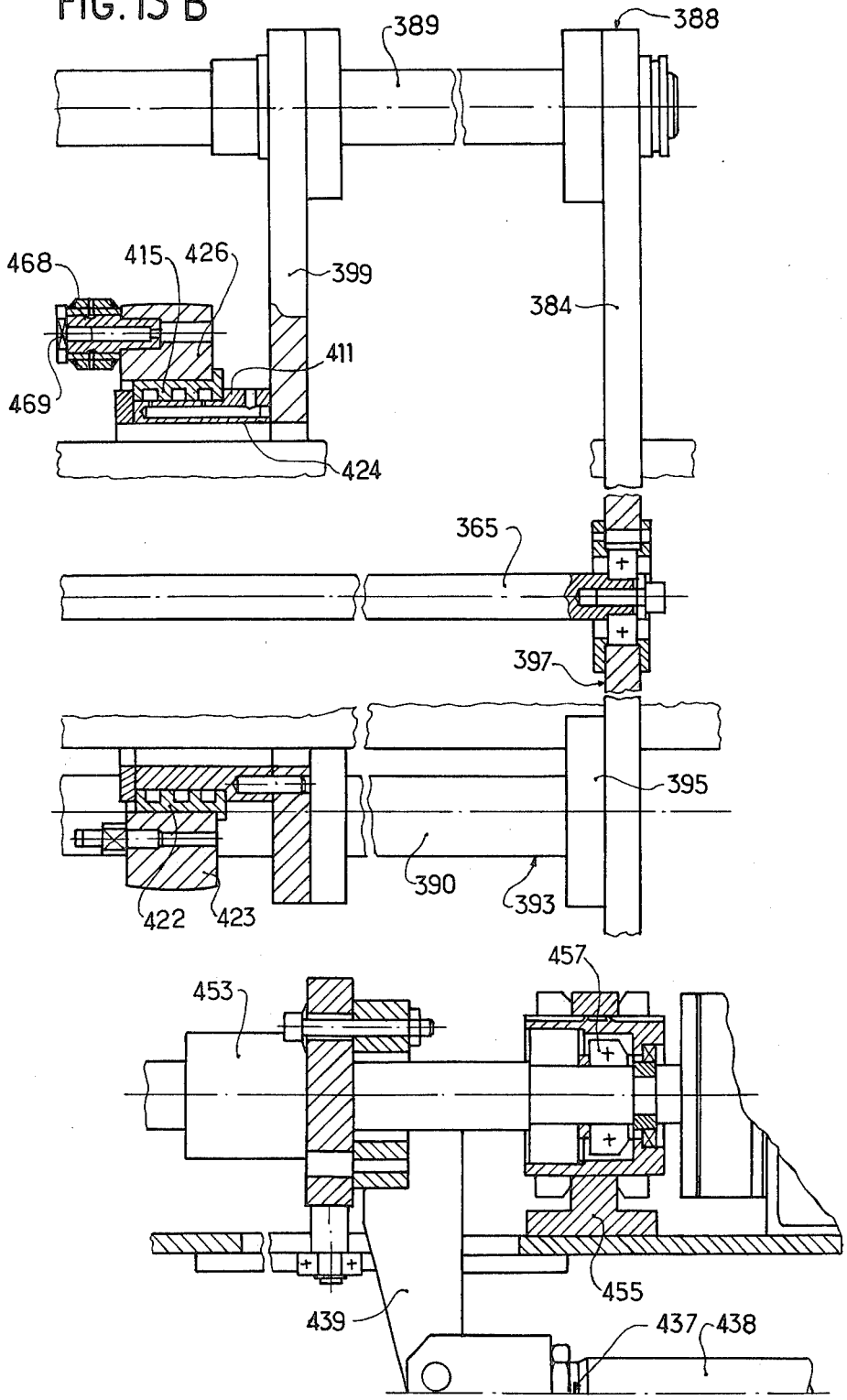

Referring to FIG. 12:

The moveable mandrel 483 is mounted on an axis 485 sliding across bearings 486, 487 disposed inside the fixed mandrel 148 inside the frustoconical end portion 149. An end 488 of this sliding axis 485 is fixed to the lower end 489 of a junction piece 490 of which the upper end 491 is fixed to the forward end 492 of the axis 157.

Thus, when a traction is exerted on the upper axis 389, this traction is transformed by the junction piece 490 into a push on the axis 485 and, consequently, on the moveable mandrel 483. By reason of this, the moveable mandrel 483 advances in the same direction as the tubular profile and at a speed synchronized with this advance.

The rear end 493 of the moveable mandrel 483 extends beyond a discharge device 494 mounted on the bottom of the frame 133. The position of the discharge device 494 is represented by the letter "F" in FIG. 1.

Figure 15:
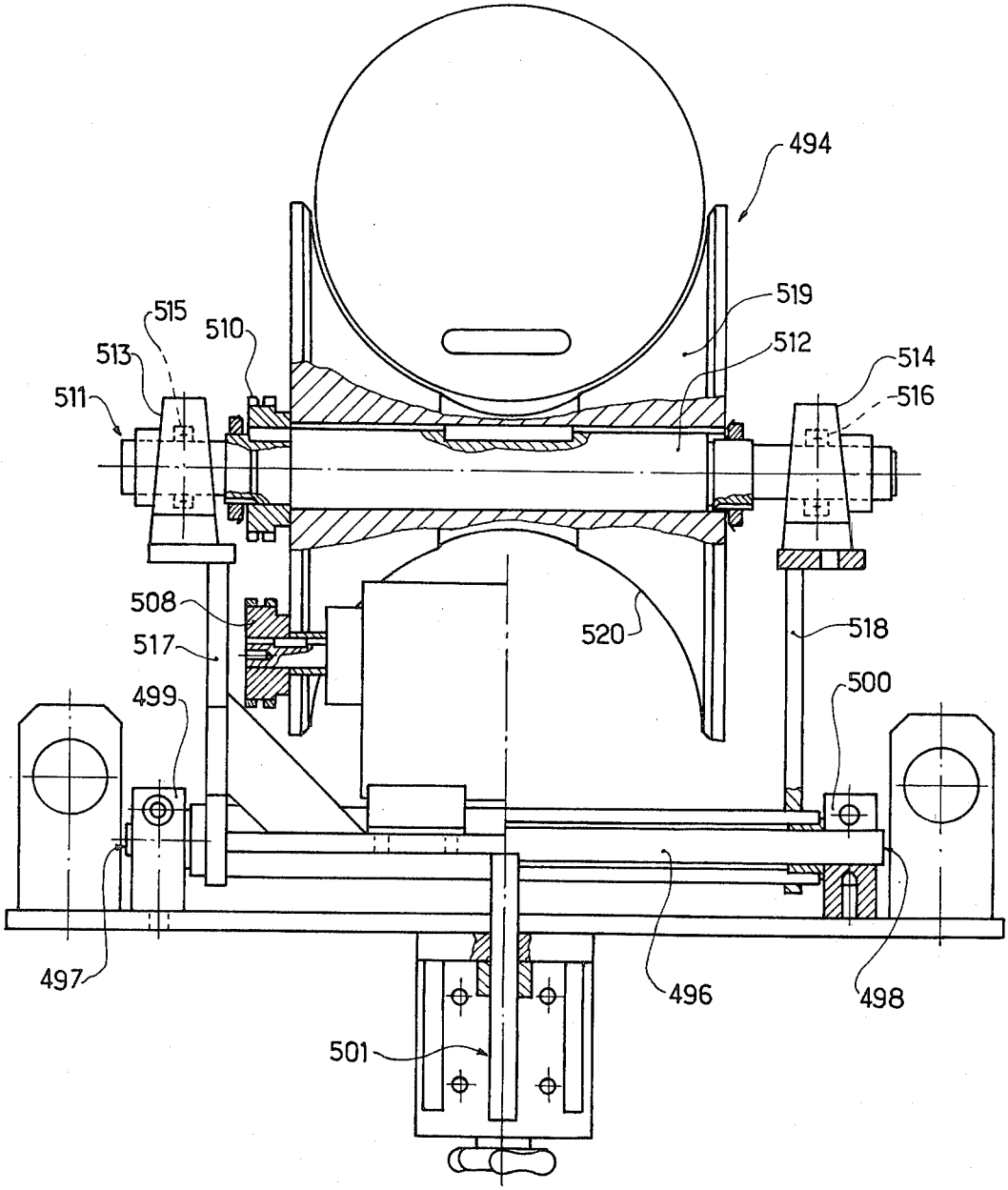
FIG. 15 is a vertical section showing the discharge mechanism.
Figure 16:
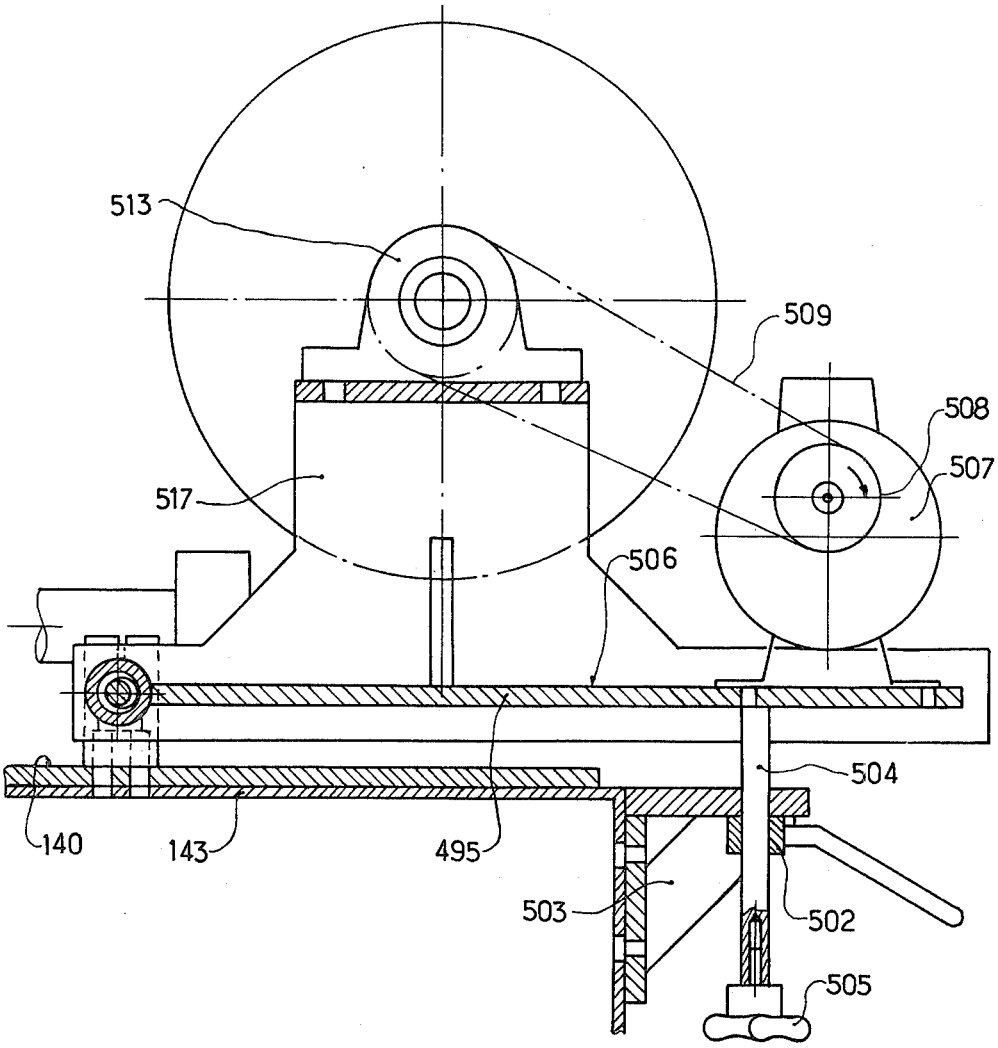
FIG. 16 is a vertical elevation partially in section, looking from the left at the same discharge mechanism.

Referring to FIGS. 15 and 16:

The discharge device comprises a plate 495 pivoted around an axis articulation 496, of which the ends 497, 498 are supported by bearings 499, 500 fixed on the bottom 140 of the frame 133. There is provided regulating means 501 comprising a nut 502 held by support 503 fixed to the frame 133 and a regulating screw 504 provided with knob or handle. By the action of this means 501 the height of the evacuation device 494 can be regulated.

On the top 506 of the plate 495 there is fixed a motor 507 provided with a driving pinion 508 which, through a chain 509, drives a pinion 510 mounted on the end 511 of a shaft 512 traversing bearing blocks 513, 514 having ball bearings 515, 516 supported by vertical supports 517, 518 fixed to the plate 495. On the shaft 512 there is a discharge roller 519. This roller 519 is fixed in rotation with the shaft 512 and has a periphery which is concave in axial section to conform to the section of the tubular profile.

The speed of rotation of the discharge roll 519 is greater than that of the set of rollers 267. By reason of this, the leading section of the tubular profile is detached from the following section.

The machine described above permits the fabrication of a tubular profile having a circular section. Moreover, the same machine can equally be used for profiles having a polygonal section. In this case it is sufficient to replace the concave rollers 275 and 297 with rollers the peripheral contour of which is adapted to the form of the profile to be produced. Likewise, the clamps 211–213 have an inner face 217 having a form permitting the clamps to conform to the different external faces of the profile.

In the case of a tubular profile of rectangular section, the upper rolls 110 and lower rolls 111 of the press 109 have a width corresponding to the widths of the small lower side of the rectangle, while the clamps 211–213 act on the two parallel large sides of the rectangle. The upper roller 297 assures the gluing of the small upper side of the rectangle. The same is true for the discharge roll 519 which in this case has a horizontal periphery.

As for the cutting blades 475, these are no longer displaced along a circular trajectory but along a horizontal trajectory. According to the section of the tubular profile, for example, rectangular, each cutting turret 425, 426 comprises four cutting assemblies 461 of which two are displaced along a horizontal trajectory, and two along a vertical trajectory. The number of the cutting assemblies 461 will be determined by the number of sides of the polygon. Indeed, the cutting blades 475 do not traverse the tubular profile but their depth of penetration in making the cut is only slightly greater than the thickness of the wall of the tubular profile.

According to another embodiment, each blade 475 revolves around the polygonal profile. However, the pivot point 458 of the pushing hydraulic jack 462 of the cutting blade 475 will be guided in a cam groove in such manner that the cutting blade 475 follows the contour of the polygonal porfile to cut all portions with identical pressure.

According to another embodiment, the cut can be equally effected with a saw blade traversing through the profile.

The machine in accordance with the invention permits the fabrication of normal packings and special packings. Thus it will be possible to produce beer containers. It is sufficient for the inner band 56 to be impermeable to obtain tight containers. These tight containers can likewise serve as containers for milk.

What is claimed is:

1. A machine for forming a continuous tubular profile and cutting it into lengths, which comprises a frame, means for feeding continuously a plurality of bands of fibrous, cellulosic, metallic, plastic, or other material, means for applying adhesive to at least one side of said bands, means for assembling said bands in superposed relation with individual bands displaced laterally relative to one another so that lateral edges of the assembly of bands are stepped, means for pressing said bands together along a central narrow width to bond them to one another in said narrow width while leaving lateral edge portion of said bands unbonded, means for progressively forming said assembly of bands into the form of said tubular profile and thereby bringing opposite lateral edges of said bands together in abutting relation to one another, means for propelling said formed assembly of bands longitudinally and for progressively applying pressure to said formed assembly of bands to bond said bands together throughout their entire width, bond opposite lateral edges of said bands together and impart to said formed assembly of bands the finished shape of said tubular profile, thereby producing a continuous tubular profile, means for cutting said continuous tubular profile into sections of predetermined length, said cutting means moving with said tubular profile during a cut, means for discharging the cut-off sections said discharge means comprising a plate pivoted about an axis, a support fixed on said support plate, a shaft on said support, a discharge roller rotatable on said shaft supported by said support, a motor mounted on said plate and driving means connecting said motor with said discharge roller to drive said discharge roller.

2. A machine according to claim 1, in which means for regulating said discharge means comprises a screw acting on said plate to pivot said plate about its pivot axis.

3. A machine for forming a continuous tubular profile and cutting it into lengths, which comprises a frame, means for feeding continuously a plurality of bands of fibrous, cellulosic, metallic, plastic, or other material, means for applying adhesive to at least one side of said bands, means for assembling said bands in superposed relation with individual bands displaced laterally relative to one another so that lateral edges of the assembly of bands are stepped, means for pressing said bands together along a central narrow width to bond them to one another in said narrow width while leaving lateral edge portions of said bands unbonded, means for progressively forming said assembly of bands into the form of said tubular profile and thereby bringing opposite lateral edges of said bands together in abutting relation to one another, means for propelling said formed assembly of bands longitudinally and for progressively applying pressure to said formed assembly of bands to bond said bands together throughout their entire width, bond opposite lateral edges of said bands together and impart to said formed assembly of bands the finished shape of said tubular profile, thereby producing a continuous tubular profile, means for cutting said continuous tubular profile into sections of predetermined length, said cutting means moving with said tubular profile during a cut, means for discharging the cut-off sections, said means for applying adhesive comprising means for applying labels to the outer band, said label-applying means comprising a vertically displaceable table, a manoeuverable arm with a suction grip for moving labels from said table to a position for application to said outer band and cooperating rollers for applying said labels to the outer surface of said outer band, said label-applying means having means modifiable in function for applying said labels continuously, step-by-step or according to a given cycle.

4. A machine according to claim 3, in which said means for applying adhesive comprises glue vats of adjustable height and provided with guide rollers, a glue-applying roller and a roller for stirring the glue in the vat.

5. A machine for forming a continuous tubular profile and cutting it into lengths, which comprises a frame, means for feeding continuously a plurality of bands of fibrous, cellulosic, metallic, plastic, or other material, means for applying adhesive to at least one side of said bands, means for assembling said bands in superposed relation with individual bands displaced laterally relative to one another so that lateral edges of the assembly of bands are stepped, means for pressing said bands together along a central narrow width to bond them to one another in said narrow width while leaving lateral edge portions of said bands unbonded, means for progressively forming said assembly of bands into the form of said tubular profile and thereby bringing opposite lateral edges of said bands together in abutting relation to one another, means for propelling said formed assembly of bands longitudinally and for progressively applying pressure to said formed assembly of bands to bond said bands together throughout their entire width, bond opposite lateral edges of said bands together and impart to said formed assembly of bands the finished shape of said tubular profile, thereby producing a continuous tubular profile, means for cutting said continuous tubular profile into sections of predetermined length, said cutting means moving with said tubular profile during a cut, means for discharging the cut-off sections, the means for pressing said bands together along a central narrow width comprising a lower roller and an upper roller having a width corresponding to the width and said bands are to be bonded for producing a tubular profile of polygonal section, said lower roller has a central cylindrical portion of a width corresponding to the width of one side of said polygon and two fustoconical portions joining opposite sides of said cylindrical portion.

6. A machine according to claim 5 in which, for producing a tubular profile of circular section, the periphery of said lower roller is concave in axial section.

7. A machine according to claim 5 in which, for producing a tubular profile of polygonal section, the upper roller has a width of one of the sides of the polygon.

8. A machine according to claim 3, in which said means for applying adhesive comprises a first set of rollers for guiding said bands, a second set of rollers for guiding said bands, and means for varying the height of the rollers of said second set to regulate the tension of the different bands.

9. A machine for forming a continuous tubular profile and cutting it into lengths, which comprises a frame, means for feeding continuously a plurality of bands of fibrous, cellulosic, metallic, plastic, or other material, means for applying adhesive to at least one side of said bands, means for assembling said bands in superposed relation with individual bands displaced laterally relative to one another so that lateral edges of the assembly of bands are stepped, means for pressing said bands together along a central narrow width to bond them to one another in said narrow width while leaving lateral edge portion of said bands unbonded, means for progressively forming said assembly of bands into the form of said tubular profile and thereby bringing opposite lateral edges of said bands together in abutting relation to one another, means for propelling said formed assembly of bands longitudinally and for progressively applying pressure to said formed assembly of bands to bond said bands together throughout their entire width, bond opposite lateral edges of said bands together and impart to said formed assembly of bands the finished shape of said tubular profile, thereby producing a continuous tubular profile, means for cutting said continuous tubular profile into sections of predetermined length, said cutting means moving with said tubular profile during a cut, means for discharging the cut-off sections, said forming means comprising a plurality of patterns comprising vertical panels provided with openings through which said assembly of bands passes, said openings being of a shape progressively to modify the form of the bands.

10. A machine according to claim 9, in which said patterns are of a shape to impart a form progressively to said bands without exerting any restraint on the different bands in order to maintain side portions of said bands independent of one another.

11. A machine for forming a continuous tubular profile and cutting it into lengths, which comprises a frame, means for feeding continuously a plurality of bands of fibrous, cellulosic, metallic, plastic, or other material, means for applying adhesive to at least one side of said bands, means for assembling said bands in superposed relation with individual means displaced laterally relative to one another so that lateral edges of the assembly of bands are stepped, means for pressing said bands together along a central narrow width to bond them to one another in said narrow width while leaving lateral edge portions of to said bands unbonded, means for progressively forming said assembly of bands into the form of said tubular profile and thereby bringing opposite lateral edges of said bands together in abutting relation to one another, means for propelling said formed assembly of bands longitudinally and for progressively applying pressure to said formed assembly of bands to bond said bands together throughout their entire width, bond opposite lateral edges of said bands together and impart to said formed assembly of bands the finished shape of said tubular profile, thereby producing a continuous tubular profile, means for cutting said continuous tubular profile into sections of predetermined length, said cutting means moving with said tubular profile during a cut, means for discharging the cut-off sections, said means for applying pressure to the formed assembly of bands comprising an inclined table having openings therein, transversely extending shafts, bearing blocks supporting said shafts on said table; two carriages movable towards and away from one another on said shafts, and means extending through said openings for moving said carriges.

12. A machine according to claim 11, in which each of said carriages comprises a frame, bearing blocks on said frame having bearings slidable on said shafts, forward and rearward vertical rotatable shafts on said frame, upper and lower sprockets on each of said vertical shafts, two chains running on said sprockets, clamp means carried by said chains and engageable with said tubular profile, and means for driving one of said vertical shafts and thereby driving said chains, and clamp means to drive said tubular profile forwardly.

13. A machine according to claim 12, in which said clamp means have inner faces having a form conforming to the section of the final tubular profile.

14. A machine according to claim 13, in which the inner face of said clamp means comprises an elastic membrane acting on the external face of said tubular profile and in which means is provided for supplying a fluid for pressing said membrane against said tubular profile.

15. A machine according to claim 14, in which said fluid supplying means comprises means for supplying fluid under positive or negative pressure to correct the thickness of said tubular profile.

16. A machine according to claim 14, in which said means for supplying fluid comprises means for controlling the temperature of said fluid to provide heat for sealing said tubular profile and cooling after sealing.

17. A machine according to claim 12, in which said means for moving said carriages toward and away from one another comprises hydraulic jacks, linkage connecting said hydraulic jacks with said carriages, means for supplying fluid pressure to said hydraulic jacks and means to assure simultaneous engagement of said clamping means with opposite sides of said tubular profile.

18. A machine according to claim 17, in which said linkage for each carriage comprises a first lever havng one end connected with said hydraulic jack and the other end fixed to a rotatable shaft, and a second lever having one end fixed to said rotatable shaft and a slot in the other end receiving a pin on said carriage.

19. A machine according to claim 18, in which, to coordinate the movements of said carriages, said first levers are interconnected by a pivoted bell-crank lever and pivoted rods connecting the two ends of said bell-crank lever with intermediate portions of said first levers of said two carriages respectively.

20. A machine for forming a continuous tubular profile and cutting it into lengths, which comprises a frame, means for feeding continuously a plurality of bands of fibrous, cellulosic, metallic, plastic, or other material, means for applying adhesive to at least one side of said bands, means for assembling said bands in superposed relation with individual bands displaced laterally relative to one another so that lateral edges of the assembly of bands are stepped, means for pressing said bands together along a central narrow width to bond them to one another in said narrow width while leaving lateral edge portions of said bands unbonded, means for progressively forming said assembly of bands into the form of said tubular profile and thereby bringing opposite lateral edges of said bands together in abutting relation to one another, means for propelling said formed assembly of bands longitudinally and for progressively applying pressure to said formed assembly of bands to bond said bands together throughout their entire width, bond opposite lateral edges of said bands together and impart to said formed assembly of bands the finished shape of said tubular profile, thereby producing a continuous tubular profile, means for cutting said continuous tubular profile into sections of predetermined length, said cutting means moving with said tubular profile during a cut, means for discharging the cut-off sections, an assembly of mandrels for said tubular profile comprising a fixed mandrel having a frustoconical end located in the proximity of said pressure applying means and a movable mandrel disposed inside said cutting means.

21. A machine according to claim 20, in which means for displacing said movable mandrel comprises a rod slidable in bearings in said fixed mandrel, said movable mandrel being joined with said rod, and means connecting said rod with said cutting means to move said movable mandrel with said cutting means.

22. A machine for forming a continuous tubular profile and cutting it into lengths, which comprises a frame, means for feeding continuously a plurality of bands of fibrous, cellulosic, metallic, plastic, or other material, means for applying adhesive to at least one side of said bands, means for assembling said bands in superposed relation with individual bands displaced laterally relative to one another so that lateral edges of the assembly of bands are stepped, means for pressing said bands together along a central narrow width to bond them to one another in said narrow width while leaving lateral edge portions of said bands unbonded, means for progressively forming said assembly of bands into the form of said tubular profile and thereby bringing opposite lateral edges of said bands together in abutting relation to one another, means for propelling said formed assembly of bands longitudinally and for progressively applying pressure to said formed assembly of bands to bond said bands together throughout their entire width, bond opposite lateral edges of said bands together and impart to said formed assembly of bands the finished shape of said tubular profile, thereby producing a continuous tubular profile, means for cutting said continuous tubular profile into sections of predetermined length, said cutting means moving with said tubular profile during a cut, means for discharging the cut-off sections, said cutting means comprising an assembly displaceable in the direction of advance of said tubular profile, said assembly comprising slide bars the slide bars mounted on the frame of the machne, two end plates supported by said shoes and connected with one another by upper and lower longitudinal shafts, and control means for controlling the assembly displacement.

23. A machine according to claim 22, in which said control means comprises a hydraulic jack having a cylinder mounted on said frame and a piston connected with said displacement assembly to advance said assembly, and a disengageable pulley for regularizing the advance of said assembly to coordinate it with the advance of said tubular section.

24. A machine according to claim 22, in which said cutting means further comprises a plurality of spaced intermediate plates between said end plates and displaceable on said longitudinal shafts connecting said end plates and provided with hubs, cutting turrets rotatable on said hubs.

25. A machine according to claim 24, in which each of said cutting turrets comprises a plurality of cutting assembies for effecting a peripheral cut of said tubular profile.

26. A machine according to claim 25, in which each cutting assembly comprises a hydraulic jack having a cylinder connected with said cutting turret and a piston, a pivoted lever actuated by said piston and provided at its ends with two rotatable cheeks rotatable and gripping a cutting blade between them, and a bearing on which the cheeks rotate.

27. A machine for forming a continuous tubular profile and cutting it into lengths, which comprises a frame, means for feeding continuously a plurality of bands of fibrous, cellulosic, metallic, plastic, or other material, means for applying adhesive to at least one side of said bands, means for assembling said bands in superposed relation with individual means displaced laterally relative to one another so that lateral edges of the assembly of bands are stepped, means for pressing said bands together along a central narrow width to bond them to one another in said narrow width while leaving lateral edge portions of to said bands unbonded, means for progressively forming said assembly of bands into the form of said tubular profile and thereby bringing opposite lateral edges of said bands together in abutting relation to one another, means for propelling said formed assembly of bands longitudinally and for progressively applying pressure to said formed assembly of bands to bond said bands together throughout their entire width, bond opposite lateral edges of said bands together and impart to said formed assembly of bands the finished shape of said tubular profile, thereby producing a continuous tubular profile, means for cutting said continuous tubular profile into sections of predetermined length, said cutting means moving with said tubular profile during a cut, means for discharging the cut-off sections, said means for progressively applying pressure comprising a lower pressure roller of which the periphery conforms to the periphery of said tubular profile, an upper pressure roller engaging the top of the tubular profile and means for pressing said upper pressure roller against said tubular profile to impart final form thereto and to press abutting edges of said tubular profile firmly together, a pivoted lever, said upper pressure roller being rotatably mounted on one end of said pivoted lever, and said means for pressing said upper pressure roller against said tubular profile comprising a hydraulic jack having a piston connected with the opposite end of said pivoted lever.

28. A machine for forming a continuous tubular profile and cutting it into lengths, which comprises a frame, means for feeding continuously a plurality of bands of fibrous, cellulosic, metallic, plastic, or other material, means for applying adhesive to at least one side of said bands, means for assembling said bands in superposed relation with individual bands displaced laterally relative to one another so that lateral edges of the assembly of bands are stepped, means for pressing said bands together along a central narrow width to bond them to one another in said narrow width while leaving lateral edge portions of said bands unbonded, means for progressively forming said assembly of bands into the form of said tubular profile and thereby bringing opposite lateral edges of said bands together in abutting relation to one another, means for propelling said formed assembly of bands longitudinally and for progressively applying pressure to said formed assembly of bands to bond said bands together throughout their entire width, bond opposite lateral edges of said bands together and impart to said formed assembly of bands the finished shape of said tubular profile, thereby producing a continuous tubular profile, means for cutting said continuous tubular profile into sections of predetermined length, said cutting means moving with said tubular profile during a cut, means for discharging the cut-off sections, driving means of said machine comprising a motor mounted on said frame and driving said pressure applying means and said cutting means.

29. A machine according to claim 28, in which said driving means comprises, a driving pulley mounted on said motor, an intermediate shaft, a pulley on said intermediate shaft and driven from said driving pulley mounted on said motor.

30. A machine according to claim 29, in which said pressure applying means comprises two carriages having speed reducers, and in which said intermediate shaft has at one of its ends a driving pulley driving through a belt two driven pulleys fixedly mounted on two transmission shafts driving said speed reducers.

31. A machine according to claim 30, in which one of said transmission shafts has a variable driving pulley driving through a belt a variable driven pulley mounted on the end of a shaft on which is mounted a sprocket driving through a chain a driven sprocket rotatable on a bushing connected with a shaft having pulleys for driving said cutting means.

32. A machine according to claim 29, in which said intermediate shaft has at an end a variable driving pulley driving through a belt a variable driven pulley mounted on a shaft carrying a driven pulley which drives through a belt a disconnectible pulley of said cutting means.

* * * * *